United States Patent [19]

Koehler

[11] 4,350,063

[45] Sep. 21, 1982

[54] ADJUSTABLE WRENCH

[76] Inventor: Robert L. Koehler, 111 S. Wilmette, Westmont, Ill. 60559

[21] Appl. No.: 207,240

[22] Filed: Nov. 17, 1980

[51] Int. Cl.[3] ..... B25B 13/52

[52] U.S. Cl. ..... 81/64; 24/279

[58] Field of Search ..... 81/64; 24/274 R, 274 P, 24/285, 279

[56] References Cited

U.S. PATENT DOCUMENTS

| | | | |
|---|---|---|---|
| 369,731 | 9/1887 | Natting | 81/64 |
| 720,816 | 2/1903 | Karl | 81/64 |
| 2,069,552 | 2/1937 | Mikulasek | 24/285 |
| 2,522,494 | 9/1950 | Baldo | 24/274 R |
| 2,607,092 | 8/1952 | Rubly | 24/274 R |

FOREIGN PATENT DOCUMENTS

| | | | |
|---|---|---|---|
| 2461338 | 1/1974 | Fed. Rep. of Germany | 24/274 R |

*Primary Examiner*—James L. Jones, Jr.
*Attorney, Agent, or Firm*—Edmond T. Patnaude

[57] ABSTRACT

A narrow band of a flexible, spring material is formed into a loop and has equally spaced, laterally extending slots threadedly engaged by a worm on a handle extending tangentially of the loop so that rotation of the handle adjusts the size of the loop.

4 Claims, 5 Drawing Figures

FIG. 1
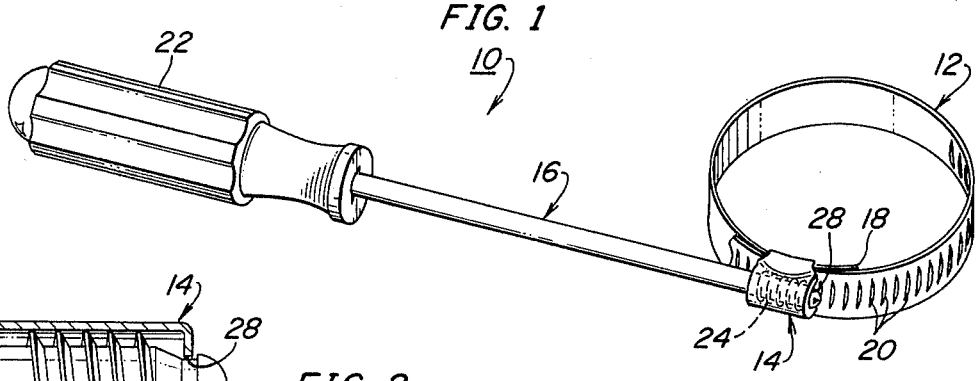
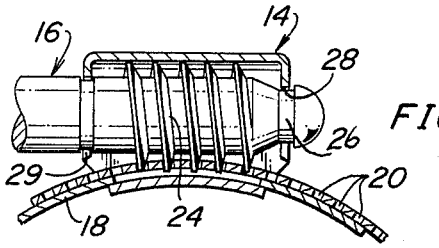
FIG. 2
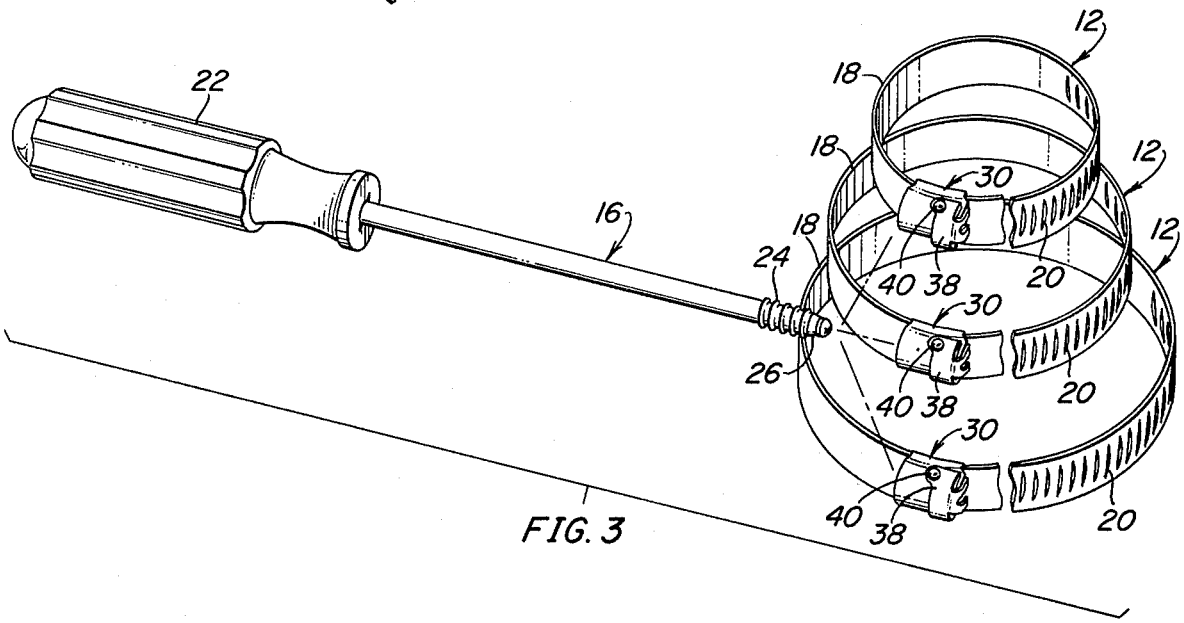
FIG. 3
FIG. 4
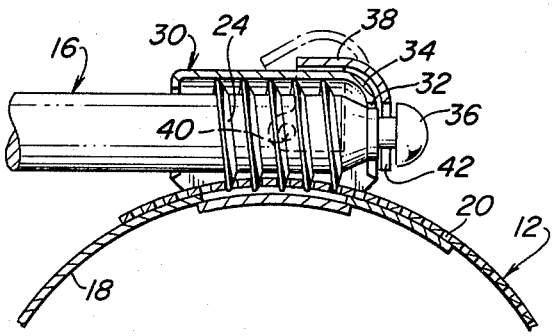
FIG. 5
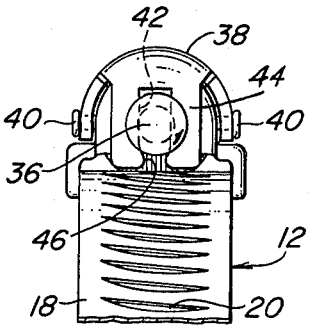

ADJUSTABLE WRENCH

The present invention relates in general to adjustable wrenches having a flexible band for engagement with the workpiece, and it relates in particular to a new and improved adjustable wrench which is inexpensive to manufacture, is easy to adjust and which automatically slips relative to the work when turned in one direction thus providing the equivalent of a ratchet wrench.

BACKGROUND OF THE INVENTION

Flexible band types of wrenches have been known in the art for a great many years although they have not been extensively used except for the removal of oil filters. The ranges of adjustment of such wrenches have been relatively limited and in most cases the wrenches have been expensive to manufacture. Since, however, flexible band wrenches have two important advantages over the more customary wrenches, i.e., they do not gouge or mar the workpiece and they are adaptable to various shapes of workpieces, it would be desirable to provide an adjustable flexible band wrench which would be easy to adjust and which would be adjustable within a wide range of sizes.

SUMMARY OF THE INVENTION

Briefly, there is provided in accordance with the present invention a new and improved adjustable wrench having a flexible band of spring metal or other material formed into a loop and provided with equally spaced lateral slots threadly engaged by a worm on an enlongated handle rotatably carried by a socket secured to the band, the handle extending tangentially to the band.

In one embodiment of the invention the handle is detachable from the socket and a plurality of bands of different length are usable with the same handle.

In use, the loop is placed over the workpiece to be rotated and the handle is rotated about its central longitudinal axis to pull the band against the workpiece. When the handle is then swung in toward the workpiece and around the axis of rotation of the workpiece the band is further tightened against the workpiece to tightly grip it. When the handle is swung in the opposite direction the band is effectively loosened from the workpiece so that it may slip thereon. If this one-way clutch action is not desired, the operator simply rotates the handle to cause the band to grip the workpiece more tightly so that the workpiece can be rotated in both directions by the handle.

GENERAL DESCRIPTION OF THE DRAWING

The present invention will be better understood by a reading of the following detailed description taken in connection with the accompanying drawing wherein:

FIG. 1 is a perspective view of an adjustable wrench embodying one aspect of the present invention;

FIG. 2 is a cross-sectonal view of the handle and socket of FIG. 1;

FIG. 3 is a perspective view of another embodiment of the invention wherein a single handle is adapted to be used with three different sized bands;

FIG. 4 is a fragmentary, cross-sectional view of another feature of the invention; and FIG. 5 is an end view taken from the right-hand side of FIG. 4.

DETAILED DESCRIPTION OF THE INVENTION

Referring particularly to FIG. 1 of the drawing an adjustable wrench 10 comprises as its principal elements a flexible band 12, a socket 14 and a handle piece 16. The band 12 is formed of spring steel or other spring-like material and is secured near its end 18 to the socket 14. A plurality of equally spaced, laterally extending slots 20 are provided in a portion of the band 12 which extends through the socket 14 to form the loop which is adapted to encircle the workpiece to be rotated.

The handle piece 16 has a hand grip 22 affixed to one end portion of a rigid shank and a worm gear 24 is provided near the other end of the shank. An annular groove 26 is provided between the outer end of the gear 24 and the adjacent end of the handle piece and is received in a slot 28 in the end wall of the socket. The other end wall of the socket is provided with a slot 29 which provides a bearing surface against which the shank of the handle piece may rotate. The slots 20 are mutually spaced by a distance equal to the pitch of the worm gear 24 which threadedly engages the slotted portion of the band extending through the socket. FIG. 2 shows the manner in which the socket functions to hold the worm gear 24 in operative engagement with the band 12.

Referring to FIGS. 3, 4 and 5, there is shown another embodiment of the invention wherein the handle piece 16 is detachably mounted to any one of a plurality of band and socket assemblies. Like parts in FIGS. 3, 4 and 5 and in FIG. 1 are designated by the same reference numbers.

In order to detachably connect the handle piece 16 to a selected one of the bands, each of the bands 12 in the embodiment of the invention shown in FIG. 3 is affixed to a socket 30 having a slot 32 in the end wall 34 larger than the enlargement 36 at the outer end of the handle piece. A locking clip 38 is pivotably attached by rivets 40 to the side walls of the socket for movement between the locking position shown in solid lines in FIG. 4 and the released position shown in phantom in FIG. 4. The clip 38 has a slot 46 in its end wall 44 which fits into the groove 26 to lock the handle piece in the socket. As shown in FIG. 4, the wall 44 has an enlargement 46 at the mouth of the slot 42 to snap-lock the clip in the locked position due to the inherent resiliency of the clip.

OPERATION

First considering the use of the wrench 10 shown in FIG. 1, the band loop is slipped over the workpiece to be rotated and the handle piece 16 is twisted or rotated in a clockwise direction about its own longitudinal axis to decrease the size of the band until it fits snuggly against the workpiece. Since the handle extends tangentially relative to the loop, by moving the handle in an upward and rearward direction as shown in FIG. 1, the band 12 is further tightened against the workpiece to tightly grip it and cause it to rotate with the handle piece. If, on the other hand, the handle piece is pulled downwardly and outwardly as shown in FIG. 1, the band will be loosened and will slip around the workpiece. It may thus be seen that if a clockwise torque is to be exerted on the workpiece the band will be placed so as to encircle the workpiece in one direction, and if a counter-clockwise torque is to be exerted on the workpiece the band will be placed so as to encircle the workpiece in the opposite direction.

It should be understood, however, that where a two-way drive is desired, the handle piece may be used to pull the band tightly against the workpiece to provide good friction engagement between the band and the workpiece irrespective of the direction in which the handle is swung.

When using the embodiment of the invention shown in FIG. 3, the band 12 of the proper size is selected and the handle piece 16 is then inserted into the associated socket. The clip 38 is then swung down into the locking position. The wrench may then be used in the same manner described above in connection with FIG. 1.

An important feature of the wrench of the present invention is the fact that the slotted end of the band 12 can be completely removed from the associated socket, looped around the workpiece and then reinserted into the socket. Accordingly, the wrench finds application where both ends of the workpiece are inaccessible.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. An adjustable wrench, comprising in combination, a narrow, flexible band of spring material having therein a plurality of equally spaced, laterally extending slots, a tubular socket member fixedly attached to said band near one end thereof, said band being formed into a generally circular loop with its other end portion extending through said socket member, an elongated rectilinear handle rotatably mounted in said socket and having a worm gear portion threadedly engaging one or more of said slots so that rotation of said handle in one direction increases the size of said loop and rotation of said handle in the opposite direction decreases the size of said loop, said socket member including a first generally tubular member having a slotted integral wall at one end through which said handle extends and with said other end being open, and clip means movably mounted to said first member for movement into a first position over said open end into locking engagement with said handle to secure said handle in said socket member in engagement with the edges of said slot and for movement into a second position displaced from said open end out of engagement with said handle to permit removal thereof from said socket member, and said handle, when locked in said socket, extends in a direction tangential to said loop.

2. An adjustable wrench according to claim 1, wherein said clip means is pivotably mounted to said socket member for pivotal movement between said first and second positions.

3. An adjustable wrench according to claim 1, wherein said handle is provided with an annular groove in proximity to the distal end thereof, and said clip means is partially disposed in said groove when said clip means is in said first position, and is displaced from said groove when said clip means is in said second position.

4. A set of adjustable wrenches as set forth in claim 1, comprising a plurality of additional narrow, flexible bands of spring material of respectively different lengths, each said band having a plurality of equally spaced, laterally extending slots, and a plurality of additional ones of said socket members fixedly attached to respective ones of said bands near one end thereof, said bands being formed into generally circular loops with the other end portions extending through the associated socket members.

* * * * *